United States Patent [19]

Kincaid

[11] 4,336,531

[45] Jun. 22, 1982

[54] SHOPLIFTING ALARM SYSTEM AND METHOD

[76] Inventor: Robert A. Kincaid, 1201 N. Alvernon - #34, Tucson, Ariz. 85712

[21] Appl. No.: 203,535

[22] Filed: Nov. 3, 1980

[51] Int. Cl.[3] ..... G08B 13/00

[52] U.S. Cl. ..... 340/568; 340/539; 340/572

[58] Field of Search ..... 340/539, 568, 574, 572

[56] References Cited

U.S. PATENT DOCUMENTS 4,189,721 2/1980 Doell ..... 340/539

*Primary Examiner*—Alvin H. Waring

*Attorney, Agent, or Firm*—Cahill, Sutton & Thomas

[57] ABSTRACT

A shoplifting system includes a first and second post-like housings positioned in a store on opposite sides of the doorway. The first housing includes an electronic receiver for receiving a wireless signal transmitted by a hand-held transmitter unit that is actuatable by a store employee who notices shoplifting activity by a shopper. The receiver causes actuating of an alarm device which issues an audible alarm sound in response to a signal received from the hand-held transmitter unit. The second housing is a "dummy" housing containing no detection circuitry. However, the second housing and first housing each have an appearance which suggests that both housings contain detection circuits that cooperate to detect the presence of detectable tags attached to products on sale in the store. A warning sign is placed on one of the housings.

9 Claims, 5 Drawing Figures

SHOPLIFTING ALARM SYSTEM AND METHOD

BACKGROUND OF THE INVENTION

1. Field of the Invention

The invention relates to systems and methods for producing shoplifting alarm signals and deterring shoplifting activity.

2. Description of the Prior Art

A number of companies manufacture shoplifting detecting systems especially suitable for use in clothing stores. Some such systems include specialized detection tags securely attached to each item of clothing on sale in the store. The systems include two "pedestals" or post-like housings disposed in the store adjacent to opposite sides of a doorway. Circuits contained in the housings cooperate to detect passage of any garment bearing one of the specialized tags between the two pedestals. This causes an audible alarm signal to be produced.

U.S. Pat. No. 3,713,133 discloses several other types of shoplifting prevention systems which utilize specialized detection tags containing resonant circuits that load an rf oscillator situated at an exit area to cause producing of an alarm signal. U.S. Pat. No. 3,713,133 also discloses tags which produce "tag removal alarm signals" upon the unauthorized opening of a safety pin which attaches the tags or "capsules" to a garment that is on sale. The above-described systems are effective, but are unduly expensive.

Therefore, it is an object of the invention to provide a shoplifting prevention system and method which is substantially less complex and less expensive than known shoplifting detection/prevention systems.

SUMMARY OF THE INVENTION

Briefly described, and in accordance with one embodiment thereof, the invention provides a shoplifting alarm system which includes first and second pedestal-like housings positioned in a store adjacent to opposite sides of an exit of the store, one of the pedestal-like housings having concealed therein a receiver capable of detecting a wireless signal and producing an alarm activating signal in response to the wireless signal. One or more hand-held transmitters having actuatable switches respectively thereon are carried by employees of the store. If an employee notices a shopper engaging in shoplifting activity, the employee actuates the switch of one of the portable transmitters, causing a wireless signal to be transmitted. The receiving means concealed in the second pedestal-like housing actuates an audible alarm, signalling other store employees to take appropriate action. The second pedestal-like housing is a "dummy" having an appearance similar to the appearance of the first pedestal-like housing, the appearance of both pedestal-like housings being such as to suggest to the average shopper that they contain electronic detection circuits actuated by concealed detection tags in garments being unlawfully removed by a shoplifter. A sign is disposed on one or more of the pedestal-like housings or elsewhere in the store warning would-be shoplifters that the establishment is electronically protected against shoplifting. Dummy tags are also securely attached to items, such as garments, on sale.

DESCRIPTION OF THE INVENTION

Figure 1:
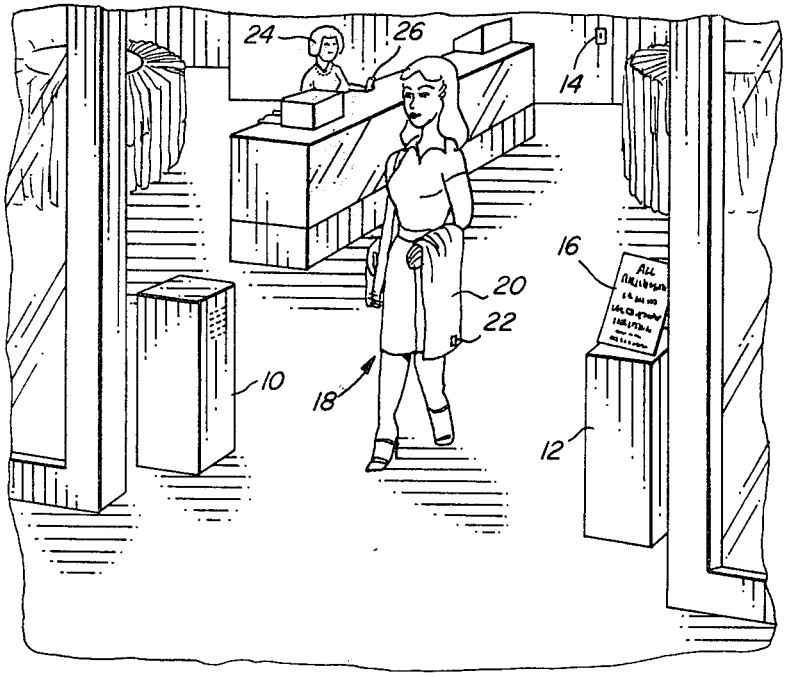
FIG. 1 is a perspective view illustrating an interior of a store in which the shoplifting protection system of the invention is installed.
Figure 2:
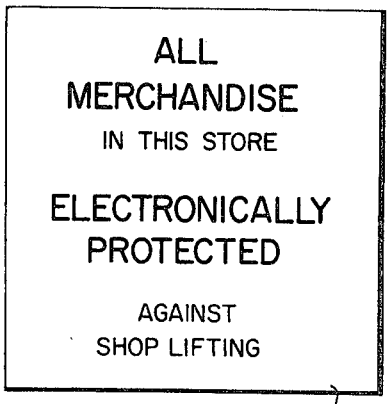
FIG. 2 is an enlarged plan view of a warning sign utilized in conjunction with the shoplifting protection system shown in FIG. 1.
Figure 3:
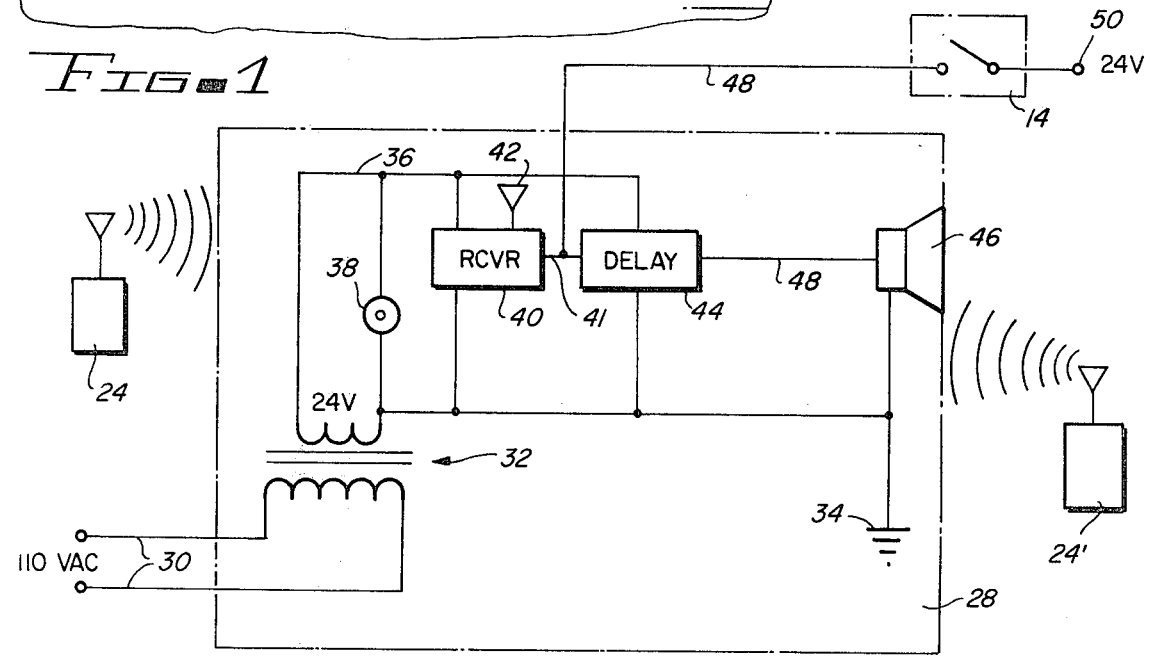
FIG. 3 is a schematic drawing illustrating the receiver and alarm unit housed in one of the pedestal-like housings of FIG. 1.

Referring now to FIG. 1, a shoplifter 18 is shown walking toward the exit of a clothing store. Shoplifter 18 is carrying a garment 20 having a "dummy" tag 22 concealed therein. Presumably, shoplifter 18 has removed another more obviously positioned unconcealed price tag from stolen garment 20.

First and second pedestal-like housings 10 and 12 are positioned within the store on opposite sides of the exit, so that any person leaving the store must pass between pedestal-like housings 10 and 12. A warning sign 16 is positioned on top of one or both of housings 10 or 12, informing shoppers and would-be shoplifters that merchandise in the store is electronically protected against shoplifting.

It is assumed, for purposes of example, that a salesperson 24 has observed the activities of shoplifter 18. Salesperson 24 has in her hand a transmitter unit 26. As subsequently explained, salesperson 24 can press a control button on transmitter 26, causing a signal to be transmitted wirelessly to a receiver contained in pedestal-like housing 10. The concealed receiver will actuate an alarm device for a preselected period of time. This will enable other personnel of the clothing store to apprehend shoplifter 18 as she passes beyond the exit of the store.

A permanent alarm button 14 is mounted on a wall within the store and is connected by means of conducting wire to the receiver in pedestal-like housing 10. If salesperson 24 had been standing close to permanent switch 14, she could have pressed the button of permanent wall switch 14. However, if salesperson 24 is not standing close to a permanent alarm switch as she notices shoplifter 18 attempting to leave the store, then hand-held transmitter 26 is capable of performing the same function as wall switch 14. Transmitter 26 can have a belt clip or other suitable means to enable salespersons to conveniently carry such transmitters with them as they conduct their activities.

Pedestal-like housing 12 is a dummy unit in that it contains no electronic component of the above-described shoplifting alarm/protection system. However, the buying public is generally aware of various electronic detection systems which detect passage of an object between cooperating electronic devices located on opposite sides of a passage way. The presence of two identically appearing pedestals 10 and 12, in conjunction with warning sign 16, alerts the average would-be shoplifter, and in many instances deters him from stealing merchandise from the store.

Referring now to FIG. 1, receiver 28 includes a step-down transformer having its primary winding connected by means of conductors 30 to a conventional 110 volt AC outlet. The secondary winding of step-down transformer 32 produces a 24 volt AC signal between conductor 36 and ground conductor 34. An on/off light 38 connected between conductors 36 and 34 indicates when power is being applied to receiver 28. A wireless "FSK" receiver having an antenna 42 thereof is connected between ground conductor 34 and conductor 36.

FSK receiver 40 can be implemented by means of a No. 1610 wireless "FSK" radio controlled receiver marketed by Alarm Device Manufacturing Company of Syosset, Long Island, N.Y.

Transmitter 24 can be implemented by means of a No. 1610 receiver, also available from Alarm Device Manufacturing Company. Receiver 40 can be used in conjunction with any number of portable transmitters, such as 24 and 24' which are located within a range of approximately 100 ft. of receiver 40.

If receiver 40 receives a suitably coded message from one of remote transmitters 24 or 24', receiver 40 produces a signal on conductor 41, which signal actuates a time delay relay unit 44. Time delay relay 44 can be implemented by means of a number SS853811 time delay relay manufactured by Macromatic, Inc. Time delay relay 44 and receiver 40 are connected between power conductors 36 and 34. The output of time delay relay 44 is connected to a horn 46, which is also connected between 24 volt power conductors 34 and 36. Horn 46 is a 24 volt AC horn which can be implemented by a means of a 874-G5 Edwards Adaptahorn. The control input conductor 48 coupling the input of receiver 40 is also connected to one terminal of permanent wall switch 14, the other conductor of which is connected to a 24 volt AC conductor.

Figure 5:
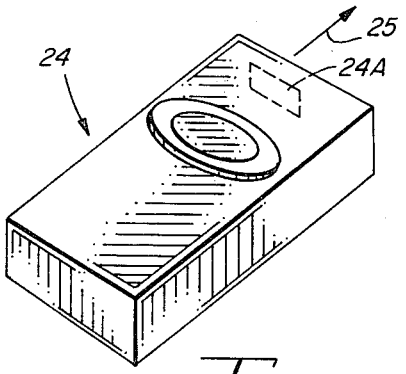
FIG. 5 is a perspective view of a hand-held transmitter unit used in the system of FIG. 1.

The appearance of transmitter 24 is shown in FIG. 5, wherein an actuating button 24A is depressed as the unit is pointed at pedestal-like housing 10. When button 24 is pressed, an rf signal indicated by arrow 24 is transmitted by transmitter 24. This signal is detected by receiver 40, which produces a signal on conductor 41, resulting in closure of a control switch of time delay relay 44. When actuating button 24A is released, transmitter 24 stops transmitting, the signal on conductor 41 disappears, and time delay relay 44 produces a signal of predetermined duration on conductor 48. (A screw driver adjustment on time delay relay 44 controls the duration of the alarm signal, allowing it to be preset for durations in the range from 1 to 10 seconds.)

Figure 4:
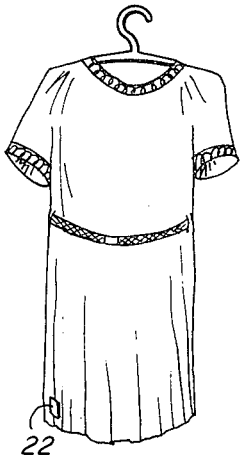
FIG. 4 is a diagram illustrating a "dummy" tag attached to a garment on sale in the store of FIG. 1.

Thus, it can be seen that the dummy pedestal-like housing 12, the dummy tags 22 (FIG. 4) and warning sign 16 are all part of a scheme designed to cause would-be shoplifters to believe that their shoplifting activities will be automatically detected by an electronic detection/alarm system, whereas actually, the described system is simply an inexpensive alarm system that relies upon the alertness and observations of salespersons to detect shoplifting activity and relies on the salespersons to then actuate the actuating button 24A or wall switch 14 to cause an alarm signal to be produced.

The disclosed system is far less complex and therefore is far less expensive than the more complex shoplifting detection/alarm systems previously mentioned. Nonetheless, the described shoplifting detection/prevention system is capable of operating in a manner which indicates to shoplifters that the entire system is not a "dummy" system and therefore, has nearly the same "deterent" capability as the more expensive shoplifting detection/alarm systems.

While the invention has been described with reference to a particular embodiment thereof, those skilled in the art will be able to make various modifications to the described embodiment of the invention without departing from the true spirit and scope of the invention, as set forth in the appended claims.

I claim:

1. A shoplifting alarm/deterent system comprising in combination:

(a) a first pedestal-like housing means positioned in a store adjacent to one side of an exit of the store;

(b) a second pedestal-like housing means in the store positioned adjacent to an opposite side of the exit, said second pedestal-like housing means having an appearance substantially similar to the appearance of said first pedestal-like housing means;

(c) means for wirelessly transmitting a first signal indicating detection by an employee of shoplifting activity by a would-be shoplifter, said transmitting means including manually actuatable switching means for causing said transmitting means to transmit said first signal;

(d) receiving means concealed in said second pedestal-like housing means for receiving said first signal and producing an alarm actuating signal in response to said first signal; and (e) alarm means responsive to said alarm actuating signal for producing an audible alarm sound.

2. The shoplifting alarm system of claim 1 wherein the store has garments on sale, said shoplifting alarm system including dummy tags attached to respective ones of said garments for suggesting to shoplifters that the dummy tags are detectable by an electronic detection device.

3. The shoplifting alarm system of claim 1 further including a warning sign indicating that the store is electronically protected against shoplifting for deterring shoplifters.

4. The shoplifting alarm system of claim 1 further including alarm lights which are actuated in response to said alarm actuating signal.

5. The shoplifting alarm system of claim 1 and wherein said alarm means and said lights are respectively disposed in and on said second pedestal-like housing means.

6. The shoplifting alarm system of claim 1 further including a permanent actuating switch connected by means of a conductor to actuate said alarm means.

7. A method of deterring shoplifting activity in a store and producing an alarm signal in response to detecting of shoplifting, said method comprising the steps of:

(a) providing an external appearance on a pedestal-like housing to cause said external appearance to be similar to the appearance of other known housings used in other stores and known by shoplifters to contain detecting apparatus that physically detects detection tags on merchandise carried past said other known housings;

(b) concealing a receiver for receiving and detecting wireless signals in said pedestal-like housing;

(c) placing said dummy pedestal-like housing adjacent to an exit of said store, whereby the similarity of said pedestal-like housing to said known housings suggests to would-be shoplifters that said pedestal-like housing contains detecting apparatus that can detect unauthorized removal of merchandise through the exit;

(d) visual detection by an employee of said store, of shoplifting of a merchandise item by a shoplifter;

(e) manual actuation by said employee, of a hand-held wireless transmitter to cause said transmitter to transmit said wireless signal to said receiver;

(f) producing said alarm signal, by means of said receiver, in response to said wireless signal; and (g) actuating an alarm device in response to said alarm signal to indicate the presence of the shoplifter in the store.

8. The method of claim 7 including the steps of placing dummy tags on garments on sale in the store.

9. The method of claim 7 including the steps of placing warning signs in the store indicating that the store is electrically protected against shoplifting.

* * * * *